US007036332B2

(12) United States Patent
Hallin et al.

(10) Patent No.: US 7,036,332 B2
(45) Date of Patent: May 2, 2006

(54) HEAT EXCHANGER ARRANGEMENT

(75) Inventors: Anders Bengt Ingemar Hallin, Lidingö (SE); Carl Lindhagen, Motala (SE); Fredrik Reithe, Linköping (SE); Anton Lundqvist, Älvsjö (SE)

(73) Assignee: Dometic Sweden AB, Solna (SE)

( * ) Notice: Subject to any disclaimer, the term of this patent is extended or adjusted under 35 U.S.C. 154(b) by 94 days.

(21) Appl. No.: 10/760,565

(22) Filed: Jan. 20, 2004

(65) Prior Publication Data

US 2005/0115263 A1 Jun. 2, 2005

(30) Foreign Application Priority Data

Dec. 1, 2003 (SE) ..... 0303234

(51) Int. Cl.
*F25D 21/06* (2006.01)

(52) U.S. Cl. ..... 62/276; 62/351

(58) Field of Classification Search ..... 62/275, 62/276, 351
See application file for complete search history.

(56) References Cited

U.S. PATENT DOCUMENTS 1,742,062 A * 12/1929 Day ..... 62/276
2,178,336 A * 10/1939 Chapman ..... 62/276
2,410,194 A * 10/1946 Baker ..... 62/276
2,814,934 A * 12/1957 Rhodes ..... 62/276
4,432,211 A 2/1984 Oishi et al.
6,266,969 B1 7/2001 Malnati et al.

FOREIGN PATENT DOCUMENTS

| | | |
|---|---|---|
| DE | 1 147 605 | 4/1963 |
| DE | 2 560 365 | 2/1984 |
| EP | 0 872 696 A2 | 10/1998 |
| EP | 0 878 675 A2 | 11/1998 |
| WO | WO 00/33004 | 6/2000 |
| WO | 03/008880 | 1/2003 |

* cited by examiner

*Primary Examiner*—Harry B. Tanner
(74) *Attorney, Agent, or Firm*—Pearne & Gordon LLP

(57) ABSTRACT

Heat exchanger arrangement for a refrigerator apparatus, which evaporator comprises an evaporator tube (2) for conducting a refrigerating medium; a heat exchanger (5, 11) with at least one heat conducting member (7, 11), which is arranged in heat conducting contact with a portion of the evaporator tube and; a heat generating element (10) for defrosting the heat exchanger, which element is arranged in heat conducting contact with the heat conducting member. For optimizing defrosting, the heat-conducting member (7, 11) is arranged essentially between the heat generating element (10) and the evaporator tube (2).

11 Claims, 1 Drawing Sheet

HEAT EXCHANGER ARRANGEMENT

FIELD OF THE INVENTION

The present invention relates to a heat exchanger arrangement for a refrigerator cabinet, which evaporator comprises an evaporator tube for conducting a refrigerating medium, a heat exchanger with at least one heat conducting member which is arranged in heat conducting contact with a portion of the evaporator tube and; a heat generating element for defrosting the heat exchanger, which element is arranged in heat conducting contact with the heat conducting member.

The invention also relates to a refrigerator cabinet comprising such an arrangement. The evaporator according to the invention is particularly useful in connection to absorption refrigerators.

BACKGROUND OF THE INVENTION

Modern refrigerator cabinets may comprise one compartment or several compartments kept at different temperatures. For household applications and also for mobile applications, such as in mobile homes and caravans, the refrigerator may comprise a freezer compartment kept at approx. −18° C. and a fridge compartment kept at approx. +5° C. The refrigerator comprises a refrigerator apparatus including a condenser and an evaporator. Compressor refrigerators further comprise a compressor, whereas absorption refrigerators instead further comprise a boiler and an absorber. The evaporator comprises an evaporator tube for conducting a cooling medium. The evaporator tube is arranged so that it passes inside the compartment or compartments, which is or are to be cooled by the refrigerator apparatus. For enhancing the heat transfer from the air in the compartments to the cooling medium, a heat exchanger is arranged in heat conducting contact with a portion of the evaporator tube arranged in the respective compartment. The main function of the heat exchanger generally is to enlarge the surface area of the heat conducting material, which is in contact with the air to be cooled and the cooling medium in the evaporator tube. For this purpose the heat exchanger typically comprises a plurality of fins, which are arranged in heat conducting contact with the evaporator tube.

During normal operation of the refrigerator cabinet, humid air enters into the compartments e.g. when the cabinet doors are opened. As the humidity condenses on the cold surfaces inside the compartments, frost is created on these cold surfaces. Such development of frost is particularly severe on the coldest surfaces, i.e. on the evaporator tube and the heat exchanger in the freezer compartment. The formation of frost on the heat exchanger deteriorates the heat transfer from the air to the cooling medium and thereby lowers the cooling power of the compartment. If the refrigerator apparatus is not dimensioned to compensate for such loss in heat transfer, the temperature in the compartment rises, while jeopardizing the condition of the foodstuff stored in the compartment or the maximum possible storage time. In order to solve this problems, modern refrigerators may comprise means for defrosting the heat exchanger at regular intervals. In such case, the defrosting means is normally applied to the heat exchanger in the freezer, but it may also be applied in the fridge.

U.S. Pat. No. 4,432,211 describes a defrosting apparatus for defrosting the heat exchanger or cooler of a refrigerator. The heat exchanger comprises a plurality of rectangular fins, which are arranged in heat conducting contact with the evaporator tube. The evaporator tube is formed as a coil, comprising two parallel coil portions, each portion comprising a number of straight horizontal tube sections arranged one above the other and connected one to the other by vertically oriented U-shaped tube bends. The two coil portions are connected to each other by a horizontally oriented U-shaped tube bend. The evaporator coil thus comprises two coil portions, generally extending in respective vertical extension planes arranged next to each other. The rectangular fins extend parallel to each other in respective vertical extension planes, which are perpendicular to the vertical extension planes of the coil portions. The straight tube sections of both coil portions are arranged through openings arranged in a mid portion, between the edges of each fin. The evaporator tube makes contact with the fins at each opening for conducting heat from the fin to the cooling medium inside the tube. This arrangement allows for air to be cooled to pass between the fins and thereby to contact the surfaces of the fins and the evaporator tube sections arranged between the fins, whereby heat may be conducted from the air to the cooling medium.

The U.S. Pat. No. 4,432,211 arrangement further comprises means for defrosting the fins and the evaporator coil. This defrosting means consists of a heater element, which is attached to the vertical edges of the fins, either on one or on both opposite sides of the fins.

WO 03/008880 A1 describes a similar arrangement where the evaporator coil is arranged perpendicular to the fins and through openings arranged in the fins. A heating element in the form of a resistive sheet is arranged in contact with the edges of the fins, at one side of the evaporator coil. For enhancing the heat transfer from the resistive film to the fins, the edge portion of the fins may be L-shaped such that the contact area between the film and the fins is enlarged. Both the above described arrangements functions in generally the same manner. The heating element is activated at regular intervals. Thereby, heat is generated and conducted from the heating element to the fins and further to the evaporator tube. The so achieved heating of the fins and the evaporator tube melts any frost, which is formed on these members. Control means may be provided for turning off the heating element when all frost has been melted.

Even though the above-described defrosting arrangements may achieve full defrosting of the heat exchanger, they are also impaired with some disadvantages. A major disadvantage concerns the arrangement of the heating element in relation to the fins and the evaporator tube. In both the prior art arrangements, the evaporator tube is arranged through openings arranged in mid portions, between the edges, of the fins. The heating element on the other hand, is arranged in contact with one edge of the fins. This means that there will always be a portion of each fin which is arranged on the opposite side of the evaporator tube as seen from that edge of the fin, which is in contact with the heating element. Expressed differently, a portion of each fin is located at a greater distance from the heating element than the opening surrounding the evaporator tube.

As a consequence, defrosting heat generated by the heating element always has to be transferred past the opening and the evaporator tube in each fin, before it reaches that portion of the fin, which is arranged on the remote side of the opening, for defrosting this remote portion. Therefore a substantial amount of defrosting heat is transferred to and absorbed by the cooling fluid in the evaporator tube, instead of being used for defrosting the remote portion of the fins.

This arrangement is most unfavorable for several reasons. Firstly, the time needed for defrosting the entire heat exchanger is prolonged, since a substantial part of the generated heat is lost and not used for defrosting. For the same reason the total energy consumption of the heating element is increased. Secondly and even more important, especially at absorption refrigerators, the cooling power of the entire refrigerator cabinet is decreased since the temperature of the cooling medium in the evaporator tube rises when the medium absorbs additional heat from the defrosting heater. Due to the increase in cooling medium temperature, the ability of the evaporator to absorb heat from the air in the refrigerator compartments and thereby to maintain these compartments at the desired temperature is decreased. This is true not only for the compartment in which the defrosting heater works, but also for any compartment cooled by a portion of the entire evaporator tube, which potion is arranged downstream of the evaporator portion in contact with the defrosted heat exchanger. Normally in dual or multi compartment refrigerators, defrosting devices area applied to the heat exchanger serving the freezer compartment. Since the freezer compartment needs the coldest evaporator temperature, this compartment is cooled by the coldest, i.e. most upstream portion of the entire evaporator tube. Hence, the defrosting heat transferred from the defrosting heater to the heat exchanger in the freezer, adversely affects the cooling power of all the compartments in the refrigerator.

Even if the refrigeration apparatus and thereby the circulation of cooling medium in the evaporator tube, is stopped during defrosting, the same problems occurs. In such case, the volume of cooling medium actually present in that portion of the evaporator tube, which is arranged in proximity to the defrosted heat exchanger, will be heated to a higher temperature. After completion of the defrosting cycle and upon restart of the cooling medium circulation, this volume of cooling medium will have to be even more reduced in temperature by the refrigeration process before it can restart to absorb heat from the compartments.

A further problem associated with the above described prior art defrosting arrangements is that heat is not evenly distributed over the fins. Due to the arrangement of the evaporator tube and the fins, the resistance to heat transfer through the material of the fins will be different at different portions of the fins. This leads to significant disadvantages during defrosting as well as during normal operation of the refrigerator. During normal operation, the uneven heat distribution over the fins will lead to that frost develops more rapidly at some colder portions of the fins than on other portions. Such local development of frost might cause the air passages between the fins to be blocked, whereby defrosting is required more often than what would be needed at an even distributed development of frost.

During defrosting, the uneven distribution of frost over the fins leads to inefficient defrosting. The areas on which less frost is formed will be defrosted faster than areas with heavy frost formation. These early defrosted areas will, during the remaining defrosting cycle for defrosting the areas with heavy frost formation, transfer excessive heat from the defrosting heater to the ambient air. Thereby, a most unwanted heating of the air in the compartment is caused together with an excessive energy consumption of the heater. Further, during defrosting, the uneven heat distribution over the fins per se causes some areas of the fins to be defrosted earlier than other areas, thereby creating the same disadvantages as just mentioned.

The above-described problems connected with the prior art defrosting arrangements are particularly severe in conjunction with mobile absorption refrigeration applications. At such applications, the physical dimensions of the refrigerator cabinet, i.e. maximal allowable height of the cabinet, limit the total cooling capacity of the refrigeration apparatus. Thus, any excessive heat added directly to the evaporator or the air in the refrigerator compartments, drastically reduces the possibility to keep the compartments at temperatures as low as nowadays desired. Further more, at some mobile applications the available electrical DC energy is often limited. Thus, an excessive energy need for defrosting is most unwanted and might even lead to battery drainage causing downtime or collapse in the various electrical systems of the vehicle.

BRIEF SUMMARY OF THE INVENTION

The general object of the present invention is therefore to provide a heat exchanger arrangement comprising a heat exchanger and a defrosting means, which arrangement permits defrosting of the heat exchanger while eliminating or reducing the above-mentioned problems.

A particular object is to provide such an arrangement, which permits energy efficient defrosting of the heat exchanger.

A further object is to provide such an arrangement, which permits defrosting of the heat exchanger, while minimizing the heat transfer from the defrosting heater to the refrigeration medium carried by the evaporator.

A still further object is to provide such an arrangement, which allows for relatively short defrosting cycles at relatively long intervals.

These objects are achieved with an arrangement according to the first paragraph of this description, at which arrangement the heat-conducting member is arranged essentially between the heat generating element and the evaporator tube. By arranging the heat conducting member between the heating element and the evaporator tube it is guaranteed that the evaporator tube is positioned at the greatest possible heat conducting distance from the heating element. By this means, all defrosting heat, generated by the heating element is forced to pass the entire heat-conducting member before it reaches the refrigeration medium in the evaporator tube. Hereby, the entire amount of heat generated by the defrosting heater is utilized for defrosting the heat-conducting member at the same time as the refrigeration medium and the refrigeration apparatus are not loaded with excessive absorption of defrosting heat.

Further objects and advantages of the invention are set out in the depending claims.

DETAILED DESCRIPTION OF THE INVENTION

Exemplifying embodiments of the invention will now be described with reference to the drawings, in which.

Figure 1:
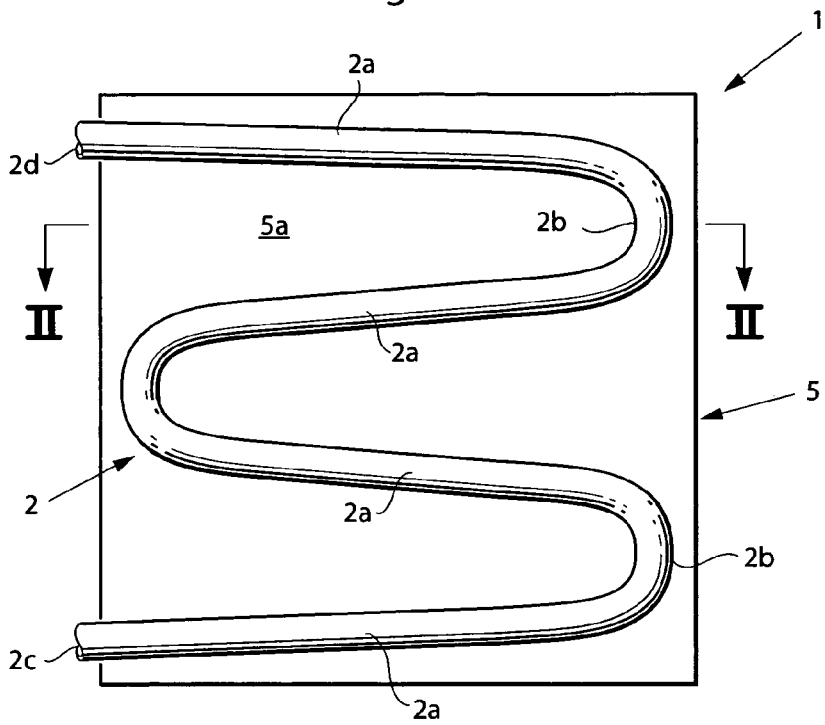
FIG. 1 is a schematic side elevation from behind of a portion of a first embodiment of an evaporator according to the invention.
Figure 2:
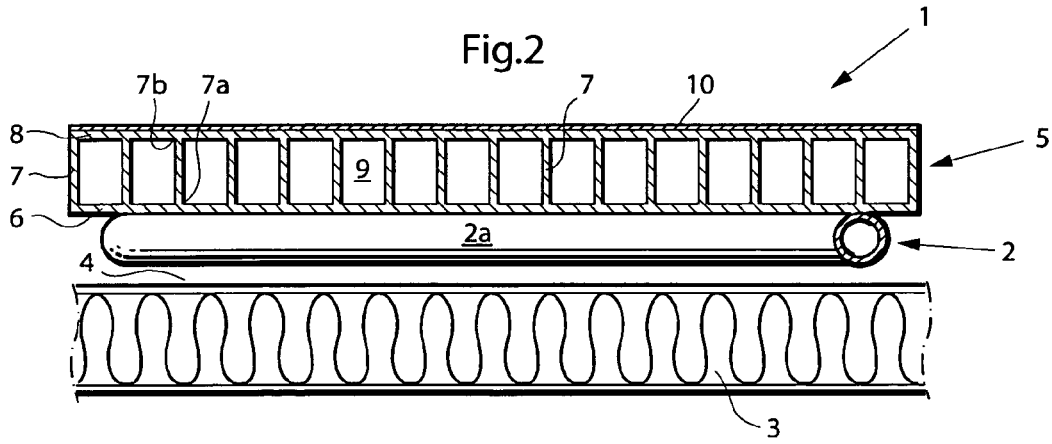
FIG. 2 is an enlarged cross section along line II in FIG. 1, also representing a sidewall of a refrigerator cabinet.

In FIG. 1 a part of an evaporator 1 is shown as seen from the back of a refrigerator cabinet with the rear wall 3 (se FIG. 2) removed. The evaporator forms part of an absorption refrigeration system including a boiler, an absorber, a condenser and an evaporator tube. The refrigerator cabinet comprises an upper freezer compartment and a lower refrigerator compartment. The temperature in the freezer is typically kept at approx. −15° to −18° C. and in the refrigerator at approx. +4 to +8° C. The freezer is cooled by an upper upstream portion 2 of the evaporator tube. This portion 2 of the evaporator tube comprises four straight tube sections 2*a* and three tube bends 2*b*. The straight tube sections 2*a* are arranged vertically one above the other and connected one after the other by respective tube bend 2*b*. The freezer portion 2 of the evaporator tube thus extends in a generally vertical extension plane, defined by the straight tube portions 2*a* and the tube bends 2*b*. As best seen in FIG. 2, the freezer portion 2 of the evaporator is arranged in proximity to the rear wall 3 such that an air circulation gap 4 is formed between the evaporator tube 2*a*, 2*b* and the rear wall 3. The downstream end 2*c* of the freezer portion 2 of the evaporator is connected to the remaining downstream evaporator tube (not shown), which comprises a refrigerator portion of the evaporator tube, which is arranged in the refrigerator compartment.

A heat exchanger 5 in the form of a fin package is arranged in heat conducting contact with the freezer portion 2 of the evaporator. The heat exchanger 5 is attached to the vertical side of the evaporator portion 2, which vertical side is opposite to the rear wall 3. The heat exchanger 5 comprises a first heat distributing base plate 6, which is in contact with the evaporator tube 2*a*, 2*b*. A plurality of heat conducting members 7 in the form of fins extends perpendicular from the base plate 6. In their vertical longitudinal direction, the fins 7 extend over the entire height of the base plate 6. The fins 7 exhibit first 7*a* and second 7*b* vertically extending side edges, the second side edges 7*b* being opposite to the first 7*a*. The first side edges 7*a* are arranged in contact with the base plate 6.

A second heat distributing plate 8 is arranged in heat conducting contact with the second side edges 7*b* of the fins 7. The second heat distributing plate 8 has essentially the same dimensions as the base plate 6 and is arranged in parallel with the base plate 6. The heat exchanger 5 thus comprises the base plate 6, the fins 7 and the second heat distributing plate 8 and forms there between vertically extending air channels 9. In the shown embodiment the heat exchanger 5, is formed in one integral piece, through extrusion of aluminum.

A heating element 10 for defrosting the heat exchanger and the evaporator tube 2*a*, 2*b* is glued or by other means attached to one side of the second heat distributing plate 8, which side is opposite to the fins 7, the base plate 6 and the evaporator tube 2*a*, 2*b*. A resistive film constitutes the heating element 10. The resistive film covers essentially the entire side surface of the second heat distributing plate 8.

During normal operation of the refrigeration cabinet, the resistive film 10 is inactivated and the refrigeration apparatus is in operation. Air in the freezer compartment circulates by self-circulation downwards through the channels 9 and the gap 4. During passage through the channels 9 and the gap 4, heat is transferred from the air, through the material in the heat exchanger 5 and evaporator tube 2*a*, 2*b*, to the interior of the evaporator tube, where it is absorbed by the cooling medium and transported downstream through the remaining evaporator tube to the absorber. During this process the temperature of the cooling medium is typically approx. −30° C. at the upstream entrance 2*d* of the freezer portion 2 of the evaporator. At the downstream end 2*c* of this evaporator portion 2, the temperature of the cooling medium has typically risen to approx. −24° C. This difference in temperature of the medium would, in the prior art arrangements, cause a significant difference in surface temperature between different areas of the heat exchanger. Also other aspects, such as the geometry and the thickness of the material of the heat exchanger would contribute to such local variations in surface temperature. The different surface temperatures would in turn cause uneven formation or build-up of frost on the heat exchanger, leading to the problems as discussed earlier in this application.

At the evaporator according to the invention however, the first 6 and second 7 heat distributing plates contributes in a large extent to equalize the temperature over the entire surface of the heat exchanger. Hereby, the formation of frost will take place at an essentially equal rate over the entire heat exchanger 5. This in turn, reduces the risk for local clogging of air passages and makes it possible to prolong the intervals between the defrosting cycles.

During defrosting, the refrigeration apparatus is deactivated and the resistive film 10 is heated by connecting an electrical voltage. The heat generated by the resistive film 10 is conducted from the film 10 to the second heat distributing plate 8 and further through the fins 7 to the first heat distributing plate 6. Since the entire heat exchanger 5, according to the invention, is located between the heating film 10 and the evaporator tube 2*a*, 2*b* all heat generated by the film 10 has to pass through the entire cross section of the heat exchanger before it reaches the evaporator tube 2*a*, 2*b*. Or expressed differently, since the evaporator tube 2*a*, 2*b* is located at the greatest possible heat conducting distance from the heating film 10, no heat has to pass the evaporator tube in order to reach any part of the heat exchanger 5. Hereby it is achieved that the refrigeration medium is not loaded with excessive heat from the defrosting heater. Further more the first 6 and second 8 heat distributing plates contributes to an even distribution of the defrosting heat over the heat exchanger. This in combination with the above-described even formation of frost, results in that the entire heat exchanger will be fully defrosted at essentially the same time. No local area of the heat exchanger will therefore dissipate excessive heat to air in the compartment because of completed defrosting of that area and subsequent local overheating earlier than other areas.

With a heat exchanger arrangement according to the invention defrosting is thus carried out in an energy efficient manner.

Figure 3:
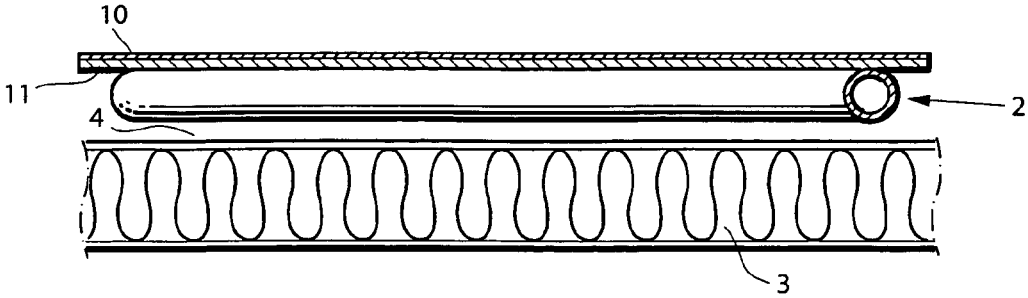
FIG. 3 is a view corresponding to FIG. 2 of a second embodiment of the invention.

FIG. 3 shows a simplified embodiment of the invention. In this embodiment the heat exchanger is constituted by a single heat conducting plate 11, which is attached in heat conducting contact to the freezer portion 2 of the evaporator and arranged in parallel to the general extension plane of this portion 2. A resistive film 10 constitutes the defrosting heating element. According to the invention, a first side surface of the heat-conducting pate is attached to the evaporator tube 2*a* and the heating element is arranged on the opposite side of the heat-conducting pate. This embodiment may be used e.g. in small compartments which do not require a large heat exchanger area.

Above, two exemplifying embodiments of the evaporator according to the invention have been described. The invention may however be varied in a many different ways within the scope of the appended claims. For instance, instead of being used in the freezer compartment of a two-compartment refrigerator cabinet, the evaporator may be applied in any compartment of a cabinet having any number of compartments. The heat exchanger may, instead of being arranged on a side of the evaporator tube facing away from the rear wall of the compartment, be arranged on any side of the evaporator tube, such as behind, above or beneath. The evaporator portion carrying the heat exchanger may be arranged near the rear wall as described above, but it may also be arranged at any other location inside a compartment as well as fully or partly embedded or enclosed in any of the walls surrounding a compartment. The heat exchanger may have any suitable configuration, as long as the surfaces for contacting air are arranged essentially between the defrost heating element and the evaporator tube. It may e.g. comprise single or multiple fins, baffles, flanges, plates or the like, which may be arranged in parallel with or at an angle to each other and at any suitable angle to the evaporator tube. It may also comprise other surface enlarging elements e.g. wool, such as steel wool or aluminum wool or members having e.g. circular, oval or polygonal cross section. The heat exchanger may be of any suitable material and formed of one single integral member or of a plurality of members interconnected by soldering, gluing, riveting or by other means.

The invention claimed is:

1. Heat exchanger arrangement for a refrigerator apparatus, which arrangement comprises an evaporator tube for conducting a refrigerating medium; a heat exchanger with at least one heat conducting member, which is arranged in heat conducting contact with a portion of the evaporator tube and; a heat generating element for defrosting the heat exchanger, which element is arranged in heat conducting contact with the heat conducting member, characterized in that the heat conducting member is arranged essentially between the heat generating element and the evaporator tube and in that the heat exchanger comprises a first heat distributing plate which is arranged between the evaporator tube and the heat-conducting member and a second heat distributing plate which is arranged between the heat generating element and the heat-conducting member.

2. Arrangement according to claim 1, wherein the heat generating element and the evaporator tube are arranged at opposite sides of the heat conducting member.

3. Arrangement according to claim 1, wherein the heat conducting member comprises a flat surface, the heat generating member and the evaporator tube being arranged at opposite edges of the flat surface.

4. Arrangement according to claim 1, wherein the heat-conducting member constitutes a fin.

5. Arrangement according to claim 4, comprising a plurality of fins, which are arranged essentially in parallel to each other.

6. Arrangement according to claim 1, wherein the heat conducting member and the first and second heat distributing plates form an integral member.

7. Arrangement according to claim 6, wherein the integral member is extruded, preferably of aluminium.

8. Arrangement according to claim 1, wherein the evaporator tube is arranged in a first extension plane and a plurality of heat conducting members are arranged essentially perpendicular to said first extension plane.

9. Arrangement according to claim 8, wherein the evaporator tube is formed with at least one tube bend, which defines the extension plane of the evaporator tube; a first heat distributing plate is arranged in contact with the evaporator tube and in parallel with the extension plane; fins are arranged on the first heat distributing plate such that a first edge of each fin makes contact with that side of the first heat distributing plate which is opposite to the evaporator tube and such that each fin extends generally perpendicular to a second heat distributing plate; the second heat distributing plate being arranged generally in parallel with the first heat distributing plate and in contact with second edges of the fins, which second edges are opposite to the first edges; and the heat generating element is arranged on that side of the second heat distributing plate, which side is opposite to the fins.

10. Arrangement according to claim 1, wherein the heat-generating element comprises a resistive film.

11. Refrigerator cabinet comprising a heat exchanger arrangement according to any of claims 1–5 and 6–10.

* * * * *

UNITED STATES PATENT AND TRADEMARK OFFICE

CERTIFICATE OF CORRECTION

PATENT NO. : 7,036,332 B2
APPLICATION NO. : 10/760565
DATED : May 2, 2006
INVENTOR(S) : Hallin et al.

It is certified that error appears in the above-identified patent and that said Letters Patent is hereby corrected as shown below:

On the Title page, under Prior Publication Data, please delete "0303234" and insert --0303235-6--

Signed and Sealed this

Twenty-first Day of November, 2006

JON W. DUDAS
*Director of the United States Patent and Trademark Office*